US007954619B2

(12) United States Patent
Nurnberg et al.

(10) Patent No.: US 7,954,619 B2
(45) Date of Patent: Jun. 7, 2011

(54) LOAD SHARING HANDRAIL DRIVE APPARATUS

(75) Inventors: Thomas Nurnberg, Port Byron, IL (US); Esko Aulanko, Kerava (FI); Glen Collison, Rock Island, IL (US); Randall Keemle, Rock Island, IL (US)

(73) Assignee: Kone Corporation, Helsinki (FI)

( * ) Notice: Subject to any disclaimer, the term of this patent is extended or adjusted under 35 U.S.C. 154(b) by 801 days.

(21) Appl. No.: 11/902,502

(22) Filed: Sep. 21, 2007

(65) Prior Publication Data

US 2008/0296125 A1 Dec. 4, 2008

Related U.S. Application Data

(60) Provisional application No. 60/924,838, filed on Jun. 1, 2007.

(51) Int. Cl.
*B66B 21/00* (2006.01)

(52) U.S. Cl. ..... 198/330; 198/322; 198/329; 198/336

(58) Field of Classification Search ..... 198/322, 198/329, 330, 336
See application file for complete search history.

(56) References Cited

U.S. PATENT DOCUMENTS

| | | | | | |
|---|---|---|---|---|---|
| 3,666,075 | A | | 5/1972 | Iwata | |
| 3,749,224 | A | | 7/1973 | Engeler | |
| 4,775,044 | A | * | 10/1988 | Hofling | 198/330 |
| 4,939,949 | A | * | 7/1990 | Langenberg | 74/473.1 |
| 5,255,895 | A | | 10/1993 | Jussilla | |
| 5,307,920 | A | | 5/1994 | Meyer et al. | |
| 5,379,877 | A | | 1/1995 | Hoefling | |
| 5,881,859 | A | * | 3/1999 | Bianchi | 198/335 |
| 5,950,797 | A | * | 9/1999 | Aulanko et al. | 198/330 |
| 6,155,401 | A | * | 12/2000 | Lunardi et al. | 198/330 |
| 6,161,674 | A | * | 12/2000 | Aulanko et al. | 198/330 |
| 6,247,575 | B1 | * | 6/2001 | Thiel | 198/330 |
| 6,273,235 | B1 | * | 8/2001 | Inoue | 198/330 |
| 6,640,959 | B1 | | 11/2003 | Haumann et al. | |
| 6,685,004 | B2 | * | 2/2004 | Fargo et al. | 198/330 |
| 6,874,613 | B2 | | 4/2005 | Pietz | |
| 6,971,497 | B2 | | 12/2005 | Illedits et al. | |
| 6,974,018 | B2 | | 12/2005 | Lunardi et al. | |
| 6,991,084 | B2 | | 1/2006 | Lunardi | |
| 7,341,139 | B2 | * | 3/2008 | Aulanko et al. | 198/335 |
| 7,357,240 | B2 | * | 4/2008 | Ogimura et al. | 198/330 |
| 7,597,182 | B2 | * | 10/2009 | Illedits et al. | 198/330 |
| 2007/0029163 | A1 | | 2/2007 | Aulanko et al. | |

OTHER PUBLICATIONS

International Search Report dated Jan. 28, 2009, issued in corresponding International Application No. PCT/US2008/006865.
Written Opinion dated Jan. 28, 2009, issued in corresponding International Application No. PCT/US2008/006865.

* cited by examiner

*Primary Examiner* — Douglas A Hess
(74) *Attorney, Agent, or Firm* — Venable LLP; Robert Kinberg; Ryan M. Flandro

(57) ABSTRACT

A handrail drive apparatus is provided comprising a first drive wheel assembly configured to drive a handrail and comprising a planetary gear train arranged to be driven by a first driving member. The handrail drive apparatus further comprises a second drive wheel assembly configured to drive the handrail, the second drive wheel assembly being coupled to the planetary gear train of the first handrail drive wheel assembly by a second driving member. The planetary gear train of the first handrail drive wheel assembly is configured to divide a torque imparted by the first driving member between the first and second drive wheel assemblies.

19 Claims, 11 Drawing Sheets

LOAD SHARING HANDRAIL DRIVE APPARATUS

CROSS-REFERENCE TO RELATED APPLICATIONS

This application is related to and claims the priority benefit of U.S. Provisional Application No. 60/924,838, filed Jun. 1, 2007, the entirety of which is incorporated herein by reference.

BACKGROUND

1. Field of Invention

The present invention relates generally to handrail drive apparatuses, and more particularly, to linear handrail drive apparatuses typically used in conjunction with moving walkways, travelators, escalators, and the like.

2. Discussion of Related Art

Linear handrail drives have existed for many years. Such handrail drives were developed to elevate handrails entirely above the step band of a moving walkway and/or escalator and thereby avoid routing the handrail down into the truss to be driven directly by the same elements arranged to drive the step band. Notwithstanding the advantages that arise from this configuration, known linear handrail drives have been fraught with problems such as difficulty in effecting adjustment, lack of reliability, capacity limitations, the inability to incorporate special handrails, and relatively rapid deterioration.

FIG. 1A depicts one example of a traditional linear handrail drive apparatus 10. The handrail drive apparatus 10 includes a plurality of driving wheel members 12 arranged to drive a handrail 14. Each of the driving wheel members 12 includes an input portion 12*a* and an output portion 12*b*. The input portions 12*a* of each of the driving wheel members 12 are connected with one another via a connecting member 16 such as, for example, a chain or belt or the like. A drive motor 18 is coupled to the input portion 12*a* of at least one of the driving wheel members 12 via an input connecting member 16*a*. The handrail 14 is forced against the output portion 12*b* of each driving wheel member 12 by a respective pinch roller 20 positioned on an opposite side of the handrail 14. In operation, the drive motor 18 drives one of the driving wheel members 12 which, in turn, drives another driving wheel member 12 via connecting member 16 at substantially the same angular velocity. As a result, the output portions 12*b* of each driving wheel member 12 drive the handrail 14 to move. When the structural attributes of all of the foregoing members in the handrail drive apparatus 10 are equal (e.g., the diameter and hardness of each of the driving wheel members 12 are equal; the pinch force applied to the handrail 14 by each pinch roller 20 is equal), and the angular velocities of members 12 are equal, the linear velocity of the output portion 12*b* of each driving wheel member 12 will also be equal. Consequently, the linear velocity imparted to the handrail 14 by each of the driving wheel members 12 is equal since the rolling radii of the driving wheel members 12 are equal.

Generally, however, the respective driving wheel members 12 are not equal in all respects due to various differences and defects inherent in standard manufacturing processes. For example, the output portion 12*b* of one or more driving wheel members 12 may not be completely round or may have a diameter that differs slightly from one or more of the other driving wheel members 12. As another example, one or more driving wheel members 12 may have different hardnesses and/or the pinch force applied to the handrail 14 by each respective pinch roller 20 may not be consistent. Any of the foregoing differences can effectively create differing rolling radii in each of the driving wheel members 12. As shown in FIG. 1A, for example, the rolling radii of the respective output portions 12*b* of the driving wheel members 12 may not be equal to one another and, as a result, the output portion 12*b* having the smaller radius will attempt to drive the handrail 14 at a slower linear velocity than the output portion 12*b* having the larger radius. Where the driving wheel members 12 attempt to drive the handrail 14 at different linear velocities, slipping or scrubbing of some or all of the driving wheel members 12 against the handrail 14 must occur for the handrail 14 to move. As one of ordinary skill in the art will recognize, operation involving slipping/scrubbing introduces inefficiencies related to dynamic friction coefficients, whereas operation under pure rolling conditions takes advantage of more efficient static friction coefficients. The end result is an inefficient drive apparatus with high wear, increased debris generation, and reduced capacity due to imperfect operating conditions.

One attempt to alleviate the inefficiencies in traditional linear handrail drives is depicted in FIG. 1B, which shows a linear handrail drive apparatus 22 including a handrail 23, a drive motor 24, an input connecting member 26, a primary driving wheel member 28, at least one secondary driving wheel member 32, a connecting member 30, and a plurality of pinch rollers 34. The drive motor 24 is drivably coupled to an input portion 28*a* of the primary driving wheel member 28 via the input connecting member 26 which may be, for example, a chain or belt or the like. An output portion 28*b* of the primary driving wheel member 28 is coupled to the at least one secondary driving wheel members 32 via a connecting member 30 which may be, for example, a chain, a poly vee or cogged belt configured to engage the handrail 23. The plurality of pinch rollers 34 are positioned opposite the primary and secondary driving wheel members 32 to force contact between the handrail 23 and connecting member 30 and thereby impart motion to the handrail 23. While this configuration offers some improvement to the above-described inefficiencies associated with traditional linear handrail drives, it also has inherent shortcomings. For example, since the linear stiffness of the connecting member 30 is typically far less than the linear stiffness of the handrail 23, the majority of driving force imparted to the handrail 23 occurs at the first pinch location (i.e., at the primary driving wheel member 28) since the driving force at downstream pinch locations is limited by the small stretch of the handrail 23 compared to the required stretch of the connecting member 30 between pinch locations to assume load. Thus, most of the load is taken on by the connecting member 30 and primary driving wheel member 28 at the first pinch location as long as, or until, the connecting member 30 becomes unable to drive the handrail 23 by itself at the first pinch location, at which time the handrail 23 slips relative to the connecting member 30, allowing stretch of the connecting member 30 and, in turn, allowing load to be transferred to the next pinch location (i.e., at the adjacent secondary driving wheel member 32). This slipping and loading cascade continues until equilibrium occurs and the handrail 23 is in motion. Thus, as long as the connecting member 30 is not able to drive the handrail 23 by itself at the first pinch location, small but continuous slipping occurs at sequential pinch locations depending on the driving force/load requirements of the handrail 23. The result is much the same as the aforementioned traditional linear handrail drives in that the apparatus causes wear of the handrail and connecting member, debris generation, and has diminished capacity due to slipping (dynamic friction coefficients) existing at most of the pinch locations.

SUMMARY

The invention is directed to a new and improved handrail drive apparatus that remedies the problems associated with past linear handrail drives and provides load sharing between drive wheel assemblies to reduce wear, improve efficiency of the drive apparatus by eliminating fighting and slipping between the handrail and drive wheel assemblies, and improve drive capacity by operating with static rather than dynamic coefficients of friction.

In one embodiment of the invention, a handrail drive apparatus is provided comprising a first drive wheel assembly configured to drive a handrail and comprising a planetary gear train arranged to be driven by a first driving member. The handrail drive apparatus further comprises a second drive wheel assembly configured to drive the handrail, the second drive wheel assembly being coupled to the planetary gear train of the first handrail drive wheel assembly by a second driving member. The planetary gear train of the first handrail drive wheel assembly is configured to divide a torque imparted by the first driving member between at least the first and second drive wheel assemblies.

The planetary gear train of the first drive wheel assembly comprises a sun gear member, a planet carrier, a ring gear member, and at least one planet gear. The sun gear member is rotatably arranged about a first axis and includes an output portion arranged to contact and drive the handrail. The planet carrier and the ring gear member are also rotatably arranged about the first axis. The at least one planet gear is coupled to the planet carrier and meshes with the sun gear and the ring gear. The at least one planet gear is arranged to rotate about a second axis extending substantially parallel to the first axis. The at least one planet gear divides the torque imparted by the first driving member to the planet carrier between the sun gear member and the ring gear member.

In another embodiment of the handrail drive apparatus, the at least one planet gear is a compound planet gear having a first portion arranged to mesh with the sun gear and a second portion arranged to mesh with the ring gear, the first and second portions of the compound planet gear having different diameters such as, for example, the diameter of the first portion of the compound planet gear being smaller than the diameter of the second portion of the compound planet gear.

In another embodiment of the invention, a handrail drive apparatus is provided comprising a first driving wheel member arranged to drive a handrail and a second wheel drive member coupled in parallel with the first driving wheel member to drive the handrail. The handrail drive apparatus further comprises means for dividing a torque required to drive the handrail between at least the first and second driving wheel members.

In still another embodiment of the invention, the handrail drive apparatus comprises a plurality of pinch rollers, each pinch roller being arranged opposite one of the first and second drive wheel assemblies to force the handrail against a drive surface of the first and second drive wheel assemblies. The plurality of pinch rollers are coupled to one another such that each pinch roller applies equal force to the handrail. A tensioned cable couples each of the plurality of pinch rollers to one another, the cable having a first end adjustably secured to a frame of the apparatus and a second end fixedly secured to the frame of the apparatus. Each of the plurality of pinch rollers comprises at least one pulley arranged to receive the cable such that tension in the cable forces the pinch roller against the handrail in a direction substantially normal to a direction of movement of the handrail. At the first end of the cable, an adjustment mechanism is provided which includes a threaded end attached to a nut and a compression spring provided between the nut and the frame to provide adjustable tension in the cable. Alternatively, the cable is adjustably secured to the frame at a first point along its length and is fixedly secured to the frame at a second point along its length. The adjustment mechanism may also include a pulley over which the cable passes at the first point along its length such that the cable extends along both sides of each pinch roller assembly.

BRIEF DESCRIPTION OF THE DRAWINGS

Examples for some embodiments of the invention will be described with respect to the following drawings, in which like reference numerals represent like features throughout the figures, and in which.

DETAILED DESCRIPTION

Figure 1A:
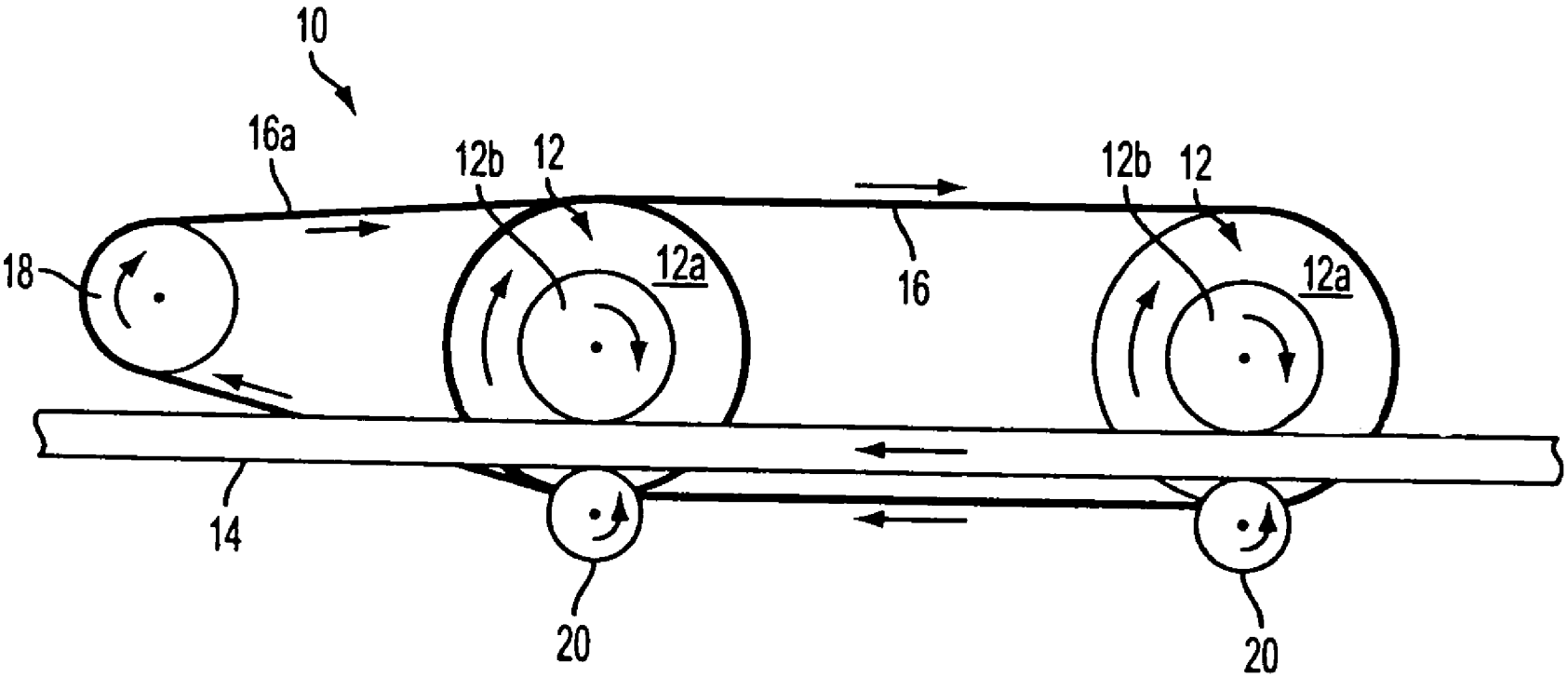
FIG. 1A PRIOR ART
FIG. 1A is a schematic side view of a known linear handrail drive apparatus.
Figure 1B:
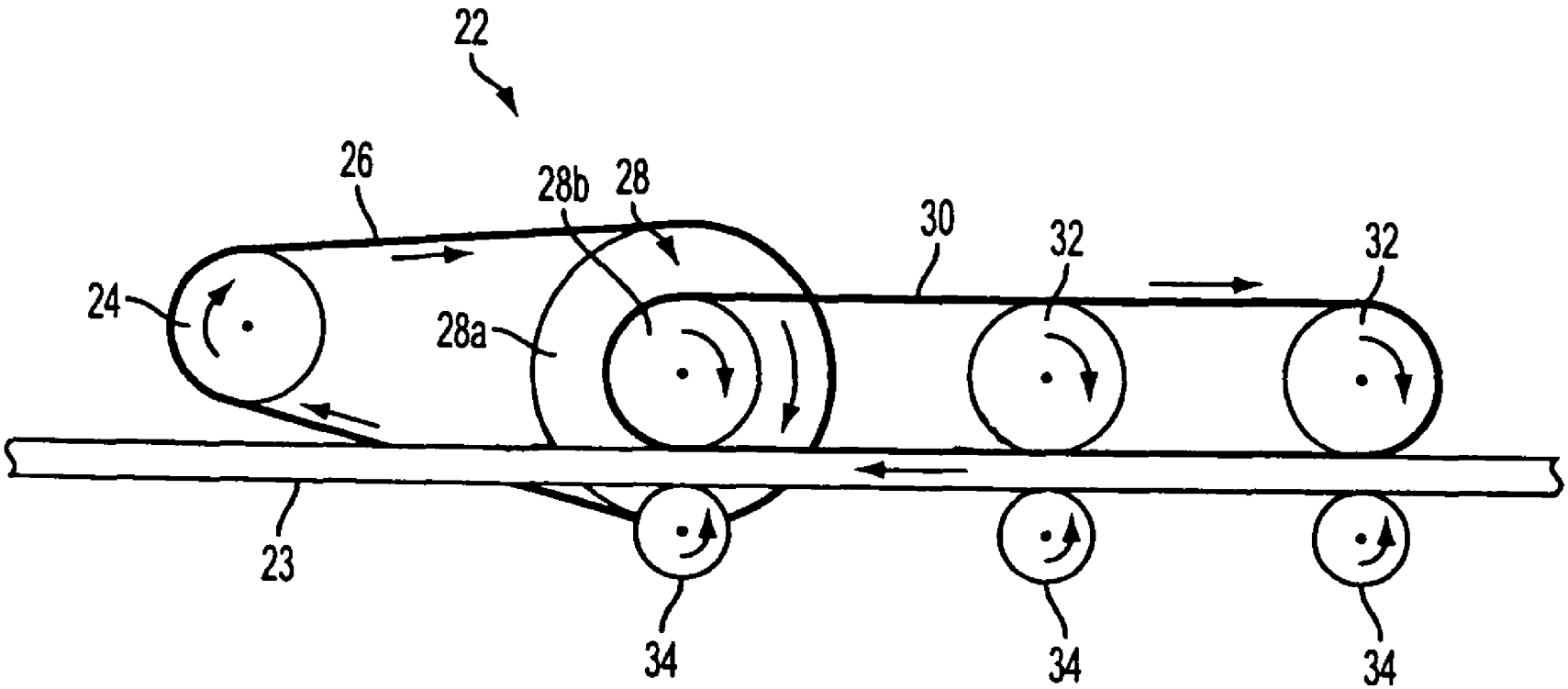
FIG. 1B PRIOR ART
FIG. 1B is a schematic side view of another known linear handrail drive apparatus.

In describing the embodiments illustrated in the drawings, specific terminology is employed for the sake of clarity. However, the invention is not intended to be limited to the specific terminology so selected. It is to be understood that each specific element includes all technical equivalents that operate in a similar manner to accomplish a similar purpose.

In the following description of certain embodiments of the invention, directional words such as "top," "bottom," "upwardly," and "downwardly" are employed by way of description and not limitation with respect to the orientation of the power generator unit and its various components as illustrated in the drawings. Similarly, directional words such as "axial" and "radial" are also employed by way of description and not limitation.

Figure 2:
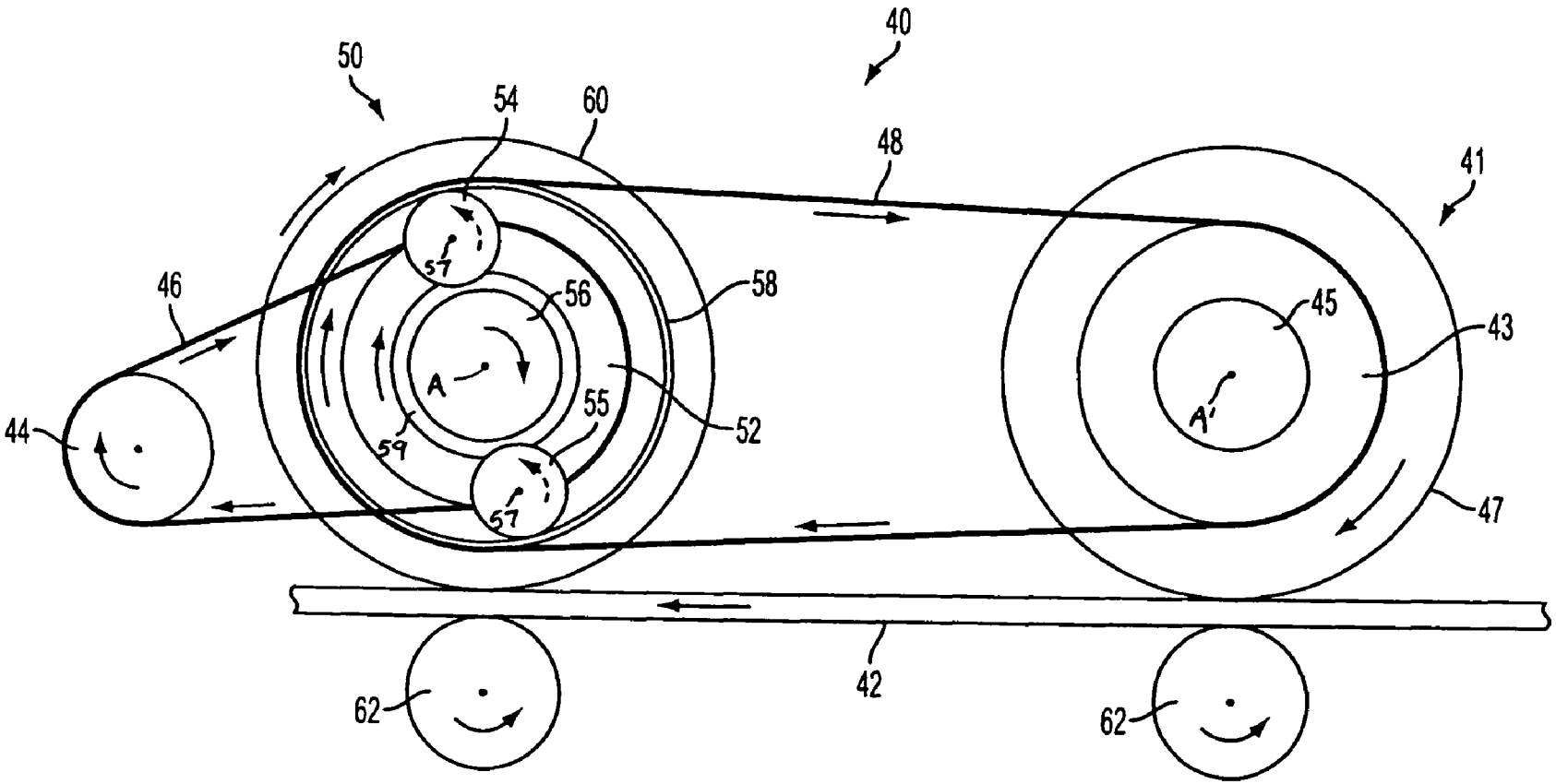
FIG. 2 is a schematic side view of a handrail drive apparatus according to an embodiment of the invention.
Figure 5A:
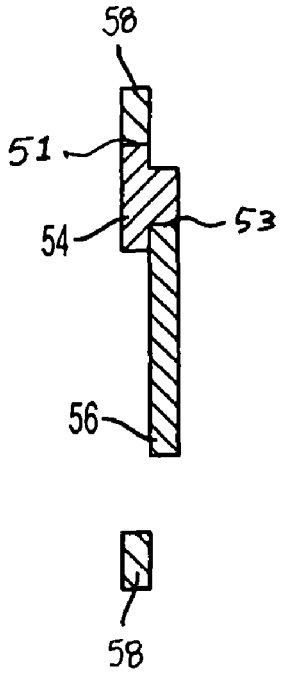
FIGS. 5A and 5B are schematic front and side views of another embodiment of a planetary gear train having a compound planet gear according to the handrail drive wheel assembly shown in FIG. 3C.
Figure 5B:
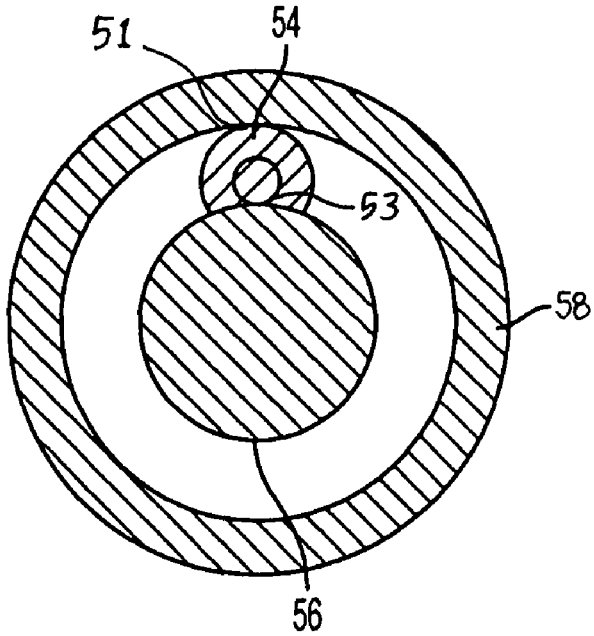

FIG. 2 is a schematic side view of a handrail drive apparatus 40 according to an embodiment of the invention. The handrail drive apparatus 40 is configured to drive a handrail 42 and includes a first drive wheel assembly 50 drivably coupled to a second drive wheel assembly 41 via a first drive member 48, which may be a belt or a chain or the like. In the embodiment shown in FIG. 2, the first drive wheel assembly 50 is drivably coupled to a drive motor 44 via an input drive member 46, which may be a belt or a chain or the like. The first drive wheel assembly 50 includes a planetary gear train for dividing a torque imparted by the input drive member 46 between the first drive wheel assembly 50 and the second drive wheel assembly 41 so that the drive wheel assemblies drive the handrail 42 in a parallel fashion. The planetary gear train of the first drive wheel assembly 50 is discussed in further detail below with reference to FIGS. 3A, 3C, and 5. Briefly, however, the planetary gear train schematically depicted in FIG. 2 is arranged rotatably about an axis A and includes a sun gear member 56, a planet carrier 52, a ring gear member 58, and at least one planet gear 54, 55. The planetary gear train functions to divide the torque between the sun gear member 56, which directly drives the handrail 42 at an output portion 60, and the ring gear member 58, which passes on the divided portion of the torque to the second drive wheel assembly 41 via first drive member 48. One of ordinary skill in the art will recognize that although two planet gears 54, 55, are included in the embodiment shown in FIG. 2, any number of planet gears can be used including one or more planet gears.

The second drive wheel assembly 41, as shown in the embodiment depicted in FIG. 2, is a unitary member 45 rotatably arranged about axis A'. The second drive wheel assembly 41 includes an input portion 43 for receiving torque input imparted by the first drive member 48 and an output portion 47 for contacting and driving the handrail 42 (see FIG. 3D). In the embodiment shown in FIG. 2, a plurality of pinch rollers 62 are also provided opposite the first and second drive wheel assemblies 50, 41, to force the handrail 42 against the output portions 60, 47 of the first and second drive wheel assemblies 50, 41 in a direction normal to the direction in which handrail 42 is driven.

Figure 3A:
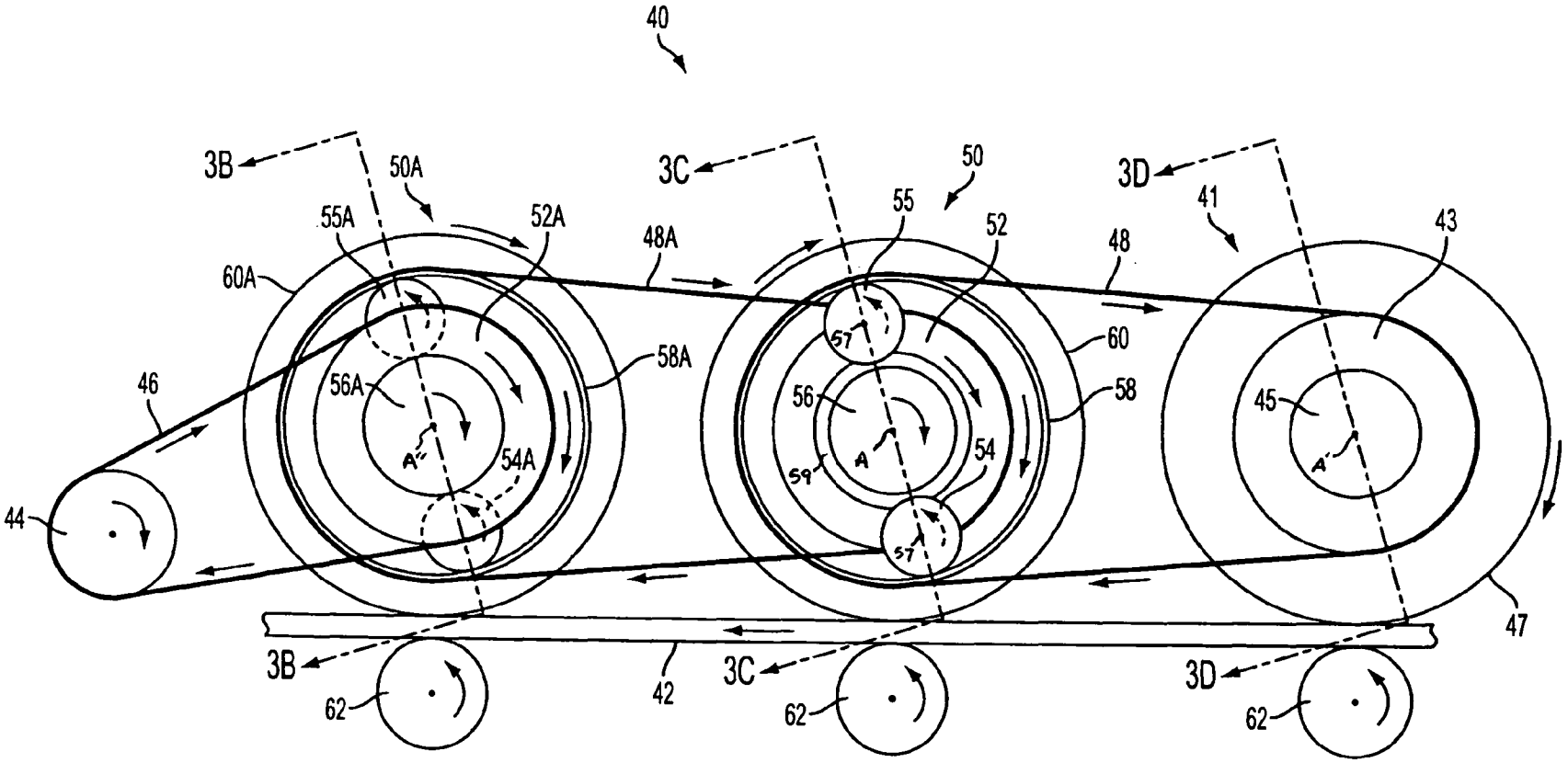
FIG. 3A is a schematic side view of a handrail drive apparatus according to another embodiment of the invention.
Figure 3B:
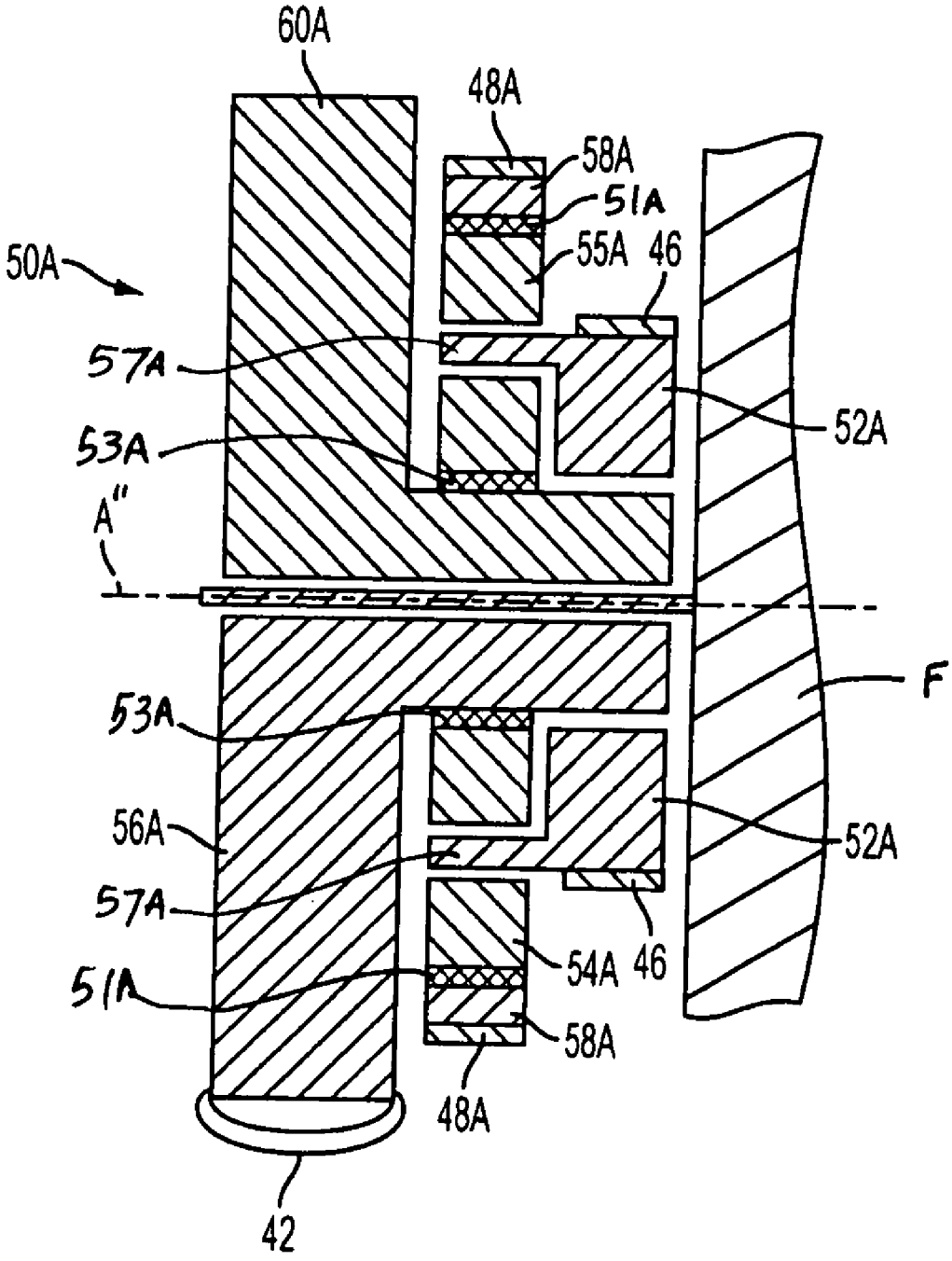
FIG. 3B is a schematic cross-sectional view of an embodiment of a handrail drive wheel assembly taken through line 3B-3B in FIG. 3A.
Figure 3C:
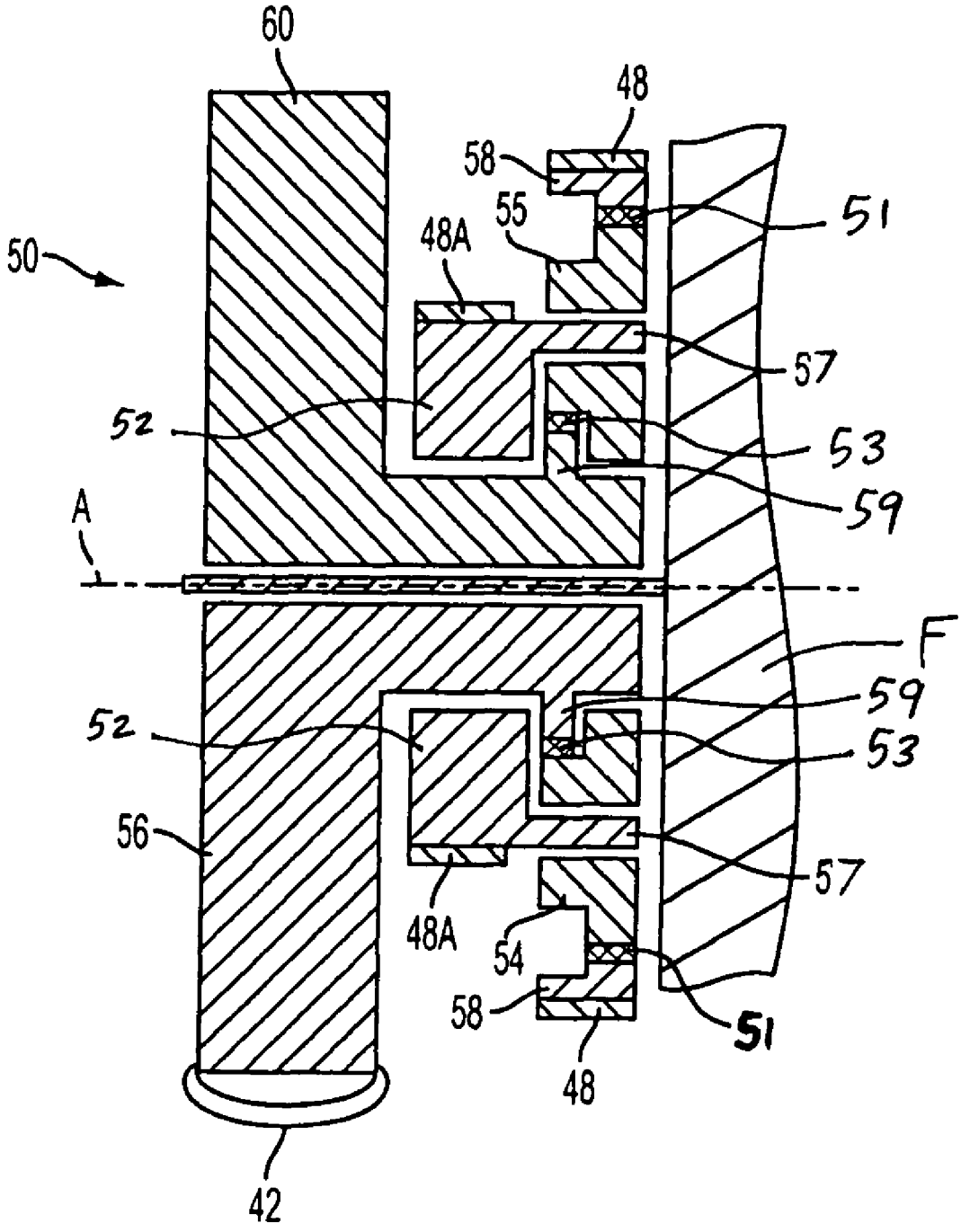
FIG. 3C is a schematic cross-sectional view of another embodiment of a handrail drive wheel assembly taken through line 3C-3C in FIG. 3A.
Figure 3D:
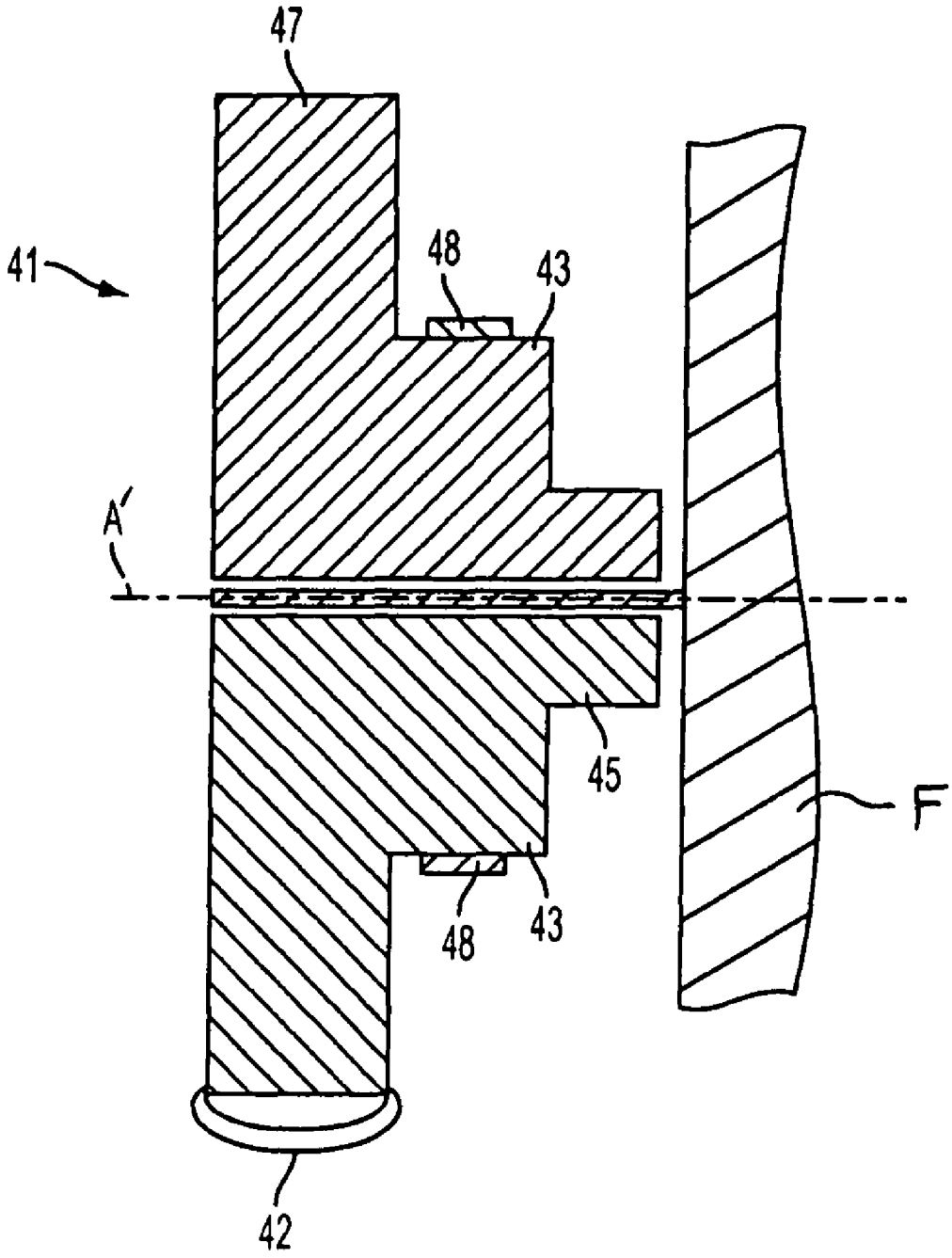
FIG. 3D is a schematic cross-sectional view of another embodiment of a handrail drive wheel assembly taken through line 3D-3D in FIG. 3A.

FIG. 3A is a schematic side view of the handrail drive apparatus 40 according to another embodiment of the invention. The handrail drive apparatus 40 in the embodiment depicted in FIG. 3A is substantially the same as that described above and depicted in FIG. 2, except that an additional drive wheel assembly 50A is disposed between the drive motor 44 and the first drive wheel assembly 50. In the embodiment depicted in FIG. 3A, the drive wheel assemblies 50A, 50, and 41 are driven in a parallel fashion rather than the series fashion of past linear handrail drives. Each of the drive wheel assemblies 50A, 50 includes a planetary gear train for torque splitting and angular velocity compensation. As in FIG. 2, the second drive wheel assembly 41 is a unitary member 45 having input and output portions 43 and 47, respectively. The torque is divided by the planetary gear trains of the drive wheel assemblies 50A, 50 based on the number of drive wheel assemblies in the apparatus as well as the gear ratios within the planetary gear trains. FIGS. 3B, 3C, and 3D are schematic cross-sectional views of the handrail drive wheel assemblies according to the embodiment shown in FIG. 3A taken through lines 3B-3B, 3C-3C, and 3D-3D, respectively.

Figure 4:
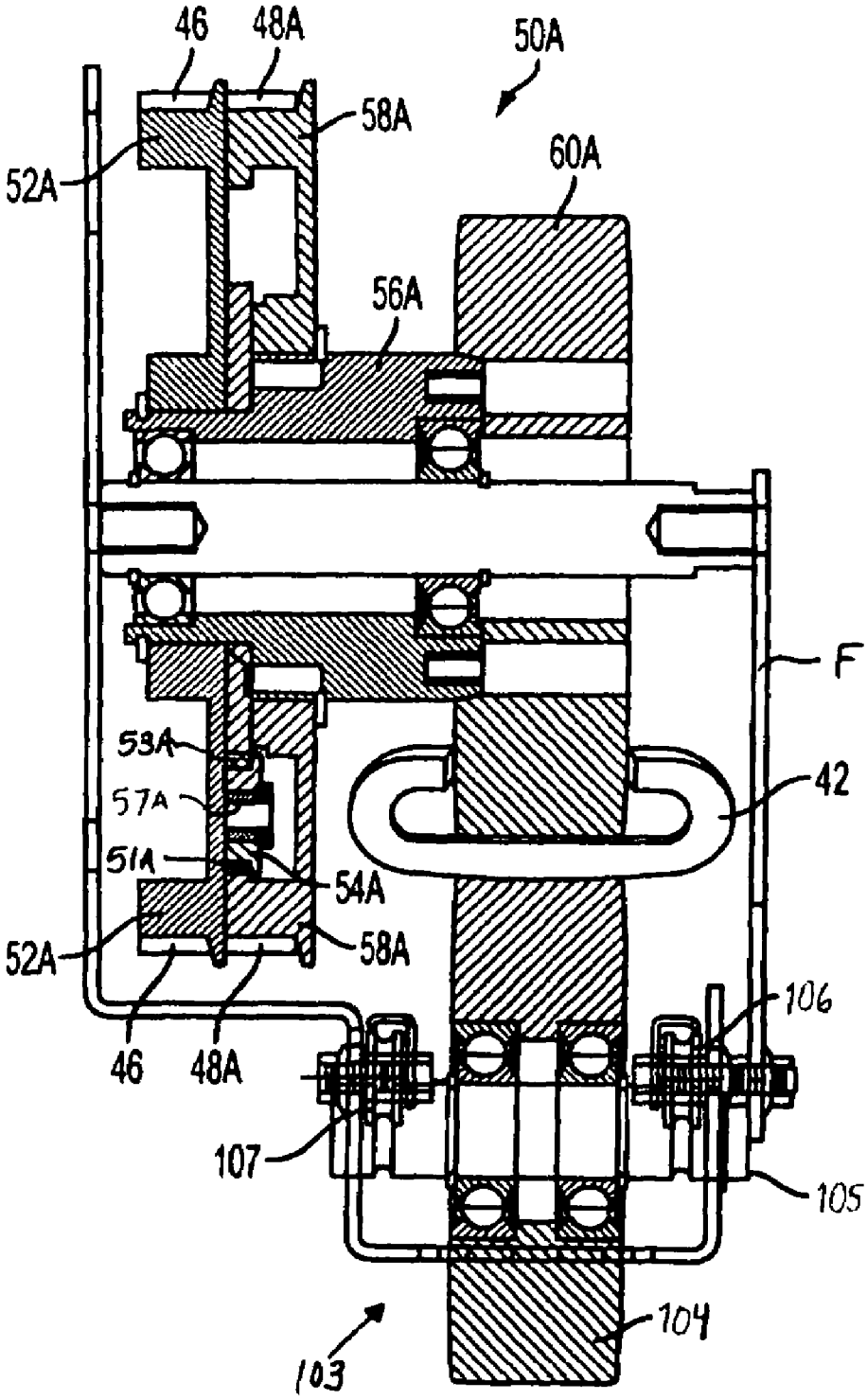
FIG. 4 is a detailed schematic cross-sectional view of the planetary gear train in the handrail drive wheel assembly depicted in FIG. 3B.

Referring to FIGS. 3A and 3B, the additional drive wheel assembly 50A is arranged rotatably about an axis A" relative to a support frame F and comprises a sun gear member 56A, a planet carrier 52A, a ring gear member 58A, and at least one planet gear 54A, 55A. FIG. 4, discussed further below, shows the planetary gear train of the additional drive wheel assembly 50A in further detail. In operation, the planet carrier 52A receives torque from the drive motor 44 via input drive member 46. Planet gears 54A, 55A are rotatably disposed on shafts 57A of the planet carrier 52A. A toothed outer surface of the planet gears 54A, 55A is meshed with a toothed outer surface of sun gear member 56A at meshing zone 53A and with a toothed inner surface of ring gear member 58A at meshing zone 51A. By virtue of the planet gears 54A, 55A, the torque input to the planet carrier 52A is divided between the sun gear member 56A, which directly drives the handrail 42 at an output portion 60A, and the ring gear member 58A, which passes on the divided portion of the torque to the first drive wheel assembly 50 via drive member 48A. The planetary gear train of the additional drive wheel assembly 50A divides the torque input from the drive motor 44 such that a smaller portion of the torque is delivered directly to the sun gear member 56A by the planet gears 54A, 55A at meshing zone 53A. The remaining larger portion of the torque is passed to the ring gear member 58A by the planet gears 54A, 55A at meshing zone 51A. The larger and smaller torque portions are based on the moment arms defined by the ring gear member 58A and the sun gear member 56A, respectively. The larger portion of the torque output is, in turn, transferred/outputted to the next sequential drive wheel assembly such as, for example, first drive wheel assembly 50, via drive member 48A which may be a chain, a belt or the like. Thus, in the embodiment depicted in FIG. 3A, torque output from the ring gear member 58A becomes the torque input to the planet carrier 52 in the first drive wheel assembly 50. This mechanical torque splitting/sharing process is repeated from one drive wheel assembly to the next until second drive wheel assembly 41 is reached. The second drive wheel assembly 41 simply receives the remaining torque from the first drive wheel assembly 50 without a need to pass on a share.

FIGS. 3A, 3C, 5A, and 5B schematically depict aspects of the planetary gear train of the first drive wheel assembly 50 according to an embodiment of the invention. The planetary gear train of first drive wheel assembly 50 is arranged rotatably about axis A relative to a support frame F and includes sun gear member 56, planet carrier 52, ring gear member 58, and at least one planet gear 54, 55. Planet gears 54, 55 are rotatably disposed on shafts 57 of the planet carrier 52. In the embodiment depicted in FIG. 3A, first drive wheel assembly 50 is operably coupled to the additional drive wheel assembly 50A via drive member 48A and to the second drive wheel assembly 41 via drive member 48. Because second drive wheel assembly 41 is the last drive wheel assembly in the apparatus it does not have a planetary gear train. Therefore, in order for first drive wheel assembly 50 to divide the torque input thereto exactly equally between itself and the second drive wheel assembly 41, the diameters of the sun and ring gear members would, in theory, be equal. In this case, the diameter of the planet gears would necessarily be zero. This, obviously, is not possible. The best torque division using a planetary gear train wherein the planet gears have one toothed surface with a single pitch diameter configured to mesh with both the sun and ring gear members (see, for example, FIG. 3B), would be about a 45-55 percentage split. However, as shown in FIG. 3C, by providing a compound planet gear 54, 55, a nearly ideal 50-50 division of the torque is achievable. The compound planet gear 54, 55 is depicted in the schematic views of the embodiments shown in FIGS. 3C, 5A, and 5B, and includes two distinct toothed surfaces having different pitch diameters. In FIG. 3C, a first of the two toothed surfaces of each of the planet gears 54, 55 is arranged to mesh with the ring gear 58 at zone 51 and a second of the two toothed surfaces of each of the planet gears 54, 55 is arranged to mesh with the sun gear member 56 at zone 53 at a radially outward end of radial extension 59.

In the handrail drive apparatus 40 depicted in the embodiment of FIG. 3A, which includes three drive wheel assemblies 50A, 50, and 41, the gearing in the additional drive wheel assembly 50A is selected to provide a torque division with approximately one-third of the torque delivered to the sun gear member 56A while the remaining two-thirds of the torque is passed on to the planet carrier 52 of the first drive wheel assembly 50. In the first drive wheel assembly 50, the planetary gear train is configured to divide the remaining two-thirds torque share substantially equally between the sun gear member 56 and the ring gear member 58, so that all three drive wheel assemblies 50A, 50, 41 assume approximately one-third of the total drive torque and load. As will be apparent to one having ordinary skill in the art, the handrail drive apparatus 40 can include any number of drive wheel assemblies such as, for example, two (e.g., FIG. 2), three (e.g., FIG. 3A), or four drive wheel assemblies (not shown) and so on, wherein the torque is divided substantially equally among the drive wheel assemblies.

If all the drive parameters (e.g., structural dimensions, hardness, and pinch wheel force) and angular velocities are perfectly equal in each of the drive wheel assemblies 50A, 50, 41, the handrail drive apparatus 40 would operate to equally divide the drive torque between the drive wheel assemblies 50, 50A, 41, according to the gear ratios within the planetary gear train of each respective drive wheel assembly without any internal movement of the planet gears 54, 55 (54A, 55A) because the rolling radii of all the drive wheel assemblies would be equal. However, because the drive parameters of such apparatuses typically vary from perfection, there are normally differences in rolling radii between the drive wheel assemblies 50, 50A, 41. As a result, the planet gears 54, 55 (54A, 55A) move internally as necessary to compensate for the rolling radii differences and, consequently, alter the angular velocity of individual drive wheel assemblies while maintaining the drive torque share provided to the handrail 42.

FIG. 4 shows a more detailed schematic cross-sectional view of the planetary gear train of the additional drive wheel assembly 50A depicted in FIGS. 3A and 3B together with one of a plurality of pinch roller assemblies 103 (discussed further below with reference to FIG. 6). The schematic figures depicted in FIGS. 2, 3A-3D, and 4 are not to scale. Although the sizes of various elements relative to other elements may differ from one figure to the next, one of ordinary skill in the art will recognize that this does not detract from the mechanical relationships intended to be depicted therein. For example, in FIG. 4, sun gear output portion 60A of the additional drive wheel assembly 50A is shown as having a smaller diameter than other elements such as, for example, ring gear 58A, whereas in FIGS. 3A and 3B, output portion 60A is shown as having a larger diameter than ring gear 58A. In both cases, however, output portion 60A forms part of sun gear member 56A and is arranged to drive the handrail 42.

Figure 6:
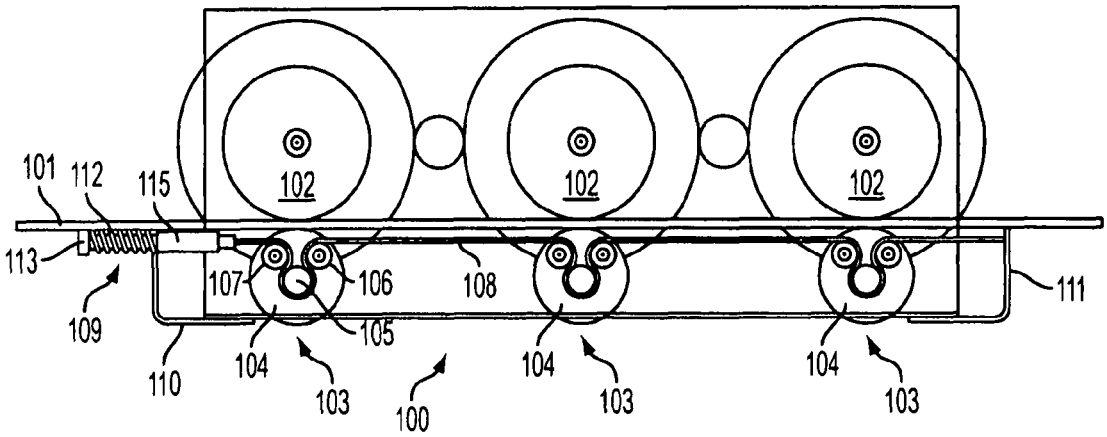
FIG. 6 is a schematic side view of a pinch roller system having an adjustable pinch force equalizer according to an embodiment of the invention.

In another embodiment of the invention shown in FIG. 6, a pinch roller force mechanism 100 is arranged to provide equal pinch force to the handrail 101 at a handrail contact point of each of a plurality of drive wheel assemblies 102 in order to minimize the affect of one of the variable drive parameters. The drive wheel assemblies 102 shown together with the pinch roller force mechanism 100 in the embodiment of FIG. 6 may be any of the drive wheel assemblies described herein or other known drive wheel assemblies. The pinch roller force mechanism 100 includes a plurality of pinch roller assemblies 103 having pinch rollers 104, each of which is arranged on an opposite side of the handrail 101 from an output portion of the drive wheel assemblies 102. The pinch rollers 104 force the handrail 101 against the output portion of each respective drive wheel assembly 102 in a direction normal to the direction of travel of the handrail 101.

Each pinch roller assembly 103 includes multiple pulleys 105, 106, 107 arranged on the pinch roller 104 such that a cable 108 received by the pulleys 105, 106, 107 forces each of the pinch rollers against the handrail 101 with equal force based on the tension in the cable 108. Each pinch roller 104 may have the pulleys 105, 106, 107 arranged on only one side thereof such that cable 108 only extends along one side of the pinch rollers 104. Alternatively, each pinch roller 104 may have the pulleys 105, 106, 107 arranged on both sides thereof such that cable 108 extends along both sides of the pinch roller 104. In this instance, cable 108 may be a single continuous cable extending along both sides of the pinch rollers 104 or, alternatively, two separate cables, each extending along a respective side of the pinch rollers 104. In the embodiment depicted in FIG. 6, the cable 108 can only be seen extending along the visible side of each pinch roller 104. The cable 108 is adjustably secured to a frame 110 via an attachment element 115 and an adjustment mechanism 109. The cable 108 is also fixedly secured to a frame 111. The attachment element 115 may be a member that receives and grips an end of the cable 108. Alternatively, attachment element 115 may be a pulley having a rotational axis parallel to the pinch force direction of each pinch roller 104 so as to allow a single continuous cable 108 having first and second ends fixedly secured to frame 111 to extend along both sides of the pinch rollers 104. In either case, adjustment mechanism 109 is coupled to the attachment element 115 and includes a threaded end attached to a nut 113. A compression spring 112 is provided between the nut 113 and the frame 110 to provide adjustable tension in the cable 108. The pinch roller force mechanism 100 provides equal tensioning and pinching magnitude at each of the drive wheel assemblies 102 as shown in FIG. 6. It is further envisioned that the cable tension could be regulated according to the driving force required from the drive wheel assemblies, thus, providing optimized pinch force to the drive and handrail as necessary and according to the drive force requirements.

Figure 7:
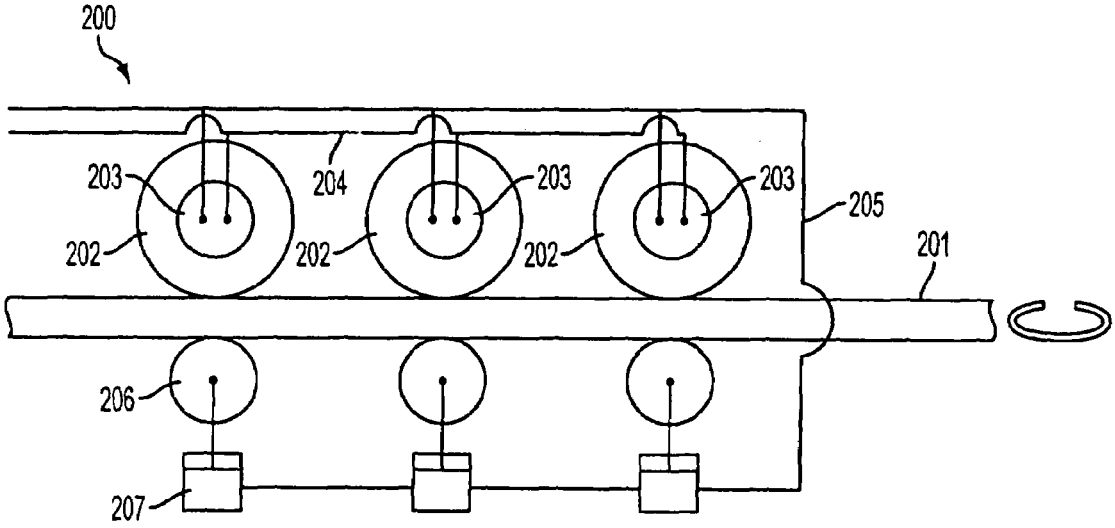
FIG. 7 is a schematic view of a handrail drive apparatus utilizing individual hydraulic motors to drive handrail drive members according to another embodiment of the invention.

As shown schematically in FIG. 7, it is also envisioned that the parallel fashion of driving a handrail described above could be achieved with a hydraulic arrangement 200. For example, in hydraulic arrangement 200, each drive wheel assembly 202 for driving a handrail 201 includes a hydraulic drive motor 203 located at and connected to the drive wheel assembly 202. The hydraulic motor 203 of each respective drive wheel assembly 202 is plumbed in parallel with the other hydraulic motors 203 via a hydraulic pressure line 204. As a result, each hydraulic motor 203 and, consequently, each drive wheel assembly 202, assumes a portion of the total drive load according to the displacement of each motor and the common pressure. As with the mechanical system counterpart described above, any variation in rolling radii or other drive parameters in any of the drive wheel assemblies 202 are compensated for by a corresponding change to the angular velocity of the corresponding motor 203 and drive wheel assembly 202 while maintaining each motor's share of the load. The hydraulic arrangement 200 may also port the pressure of the drive motors 203 along a line 205 to hydraulic cylinder(s) 207 coupled to pinch rollers 206 to provide a pinch force proportional to the drive system load resulting in optimized, load compensated pinch forces on the handrail 201 shown in FIG. 7.

It is also envisioned that the parallel fashion of driving a handrail could be accomplished electrically using a plurality of AC drive wheel motors and variable frequency control(s) (not shown).

While the invention has been described with respect to certain examples and embodiments, modifications may be made within the scope of the invention as defined by the appended claims.

What is claimed is:

1. A handrail drive apparatus comprising:

a first drive wheel assembly configured to drive a handrail and comprising a planetary gear train arranged to be driven by a first driving member; and a second drive wheel assembly configured to drive the handrail, the second drive wheel assembly being coupled to the planetary gear train of the first handrail drive wheel assembly by a second driving member, wherein the planetary gear train of the first handrail drive wheel assembly is configured to divide a torque imparted to the first drive wheel assembly by the first driving member substantially equally between the first and second drive wheel assemblies.

2. The handrail drive apparatus of claim 1, wherein the planetary gear train of the first drive wheel assembly comprises:

a sun gear member rotatably arranged about a first axis and including an output portion arranged to contact and drive the handrail;

a planet carrier rotatably arranged about the first axis;

a ring gear member rotatably arranged about the first axis; and at least one planet gear coupled to the planet carrier, wherein the at least one planet gear meshes with the sun gear and the ring gear and is arranged to rotate about a second axis extending substantially parallel to the first axis.

3. The handrail drive apparatus of claim 2, wherein the first driving member is coupled to the planet carrier to impart torque to the first drive wheel assembly.

4. The handrail drive apparatus of claim 2, wherein the second driving member is coupled between the ring gear member and the second drive wheel assembly.

5. The handrail drive apparatus of claim 3, wherein the at least one planet gear divides the torque imparted by the first driving member to the planet carrier between the sun gear member and the ring gear member.

6. The handrail drive apparatus of claim 2, wherein the at least one planet gear is a compound planet gear.

7. The handrail drive apparatus of claim 6, wherein the compound planet gear has a first portion arranged to mesh with the sun gear and a second portion arranged to mesh with the ring gear, the first and second portions of the compound planet gear having different diameters.

8. The handrail drive apparatus of claims 7, wherein the diameter of the first portion of the compound planet gear is smaller than the diameter of the second portion of the compound planet gear.

9. The handrail drive apparatus of claim 1, wherein the first driving member comprises a belt or a chain.

10. The handrail drive apparatus of claim 1, wherein the second driving member comprises a belt or a chain.

11. The handrail drive apparatus of claim 1, further comprising a plurality of pinch rollers, each pinch roller being arranged opposite one of the first and second drive wheel assemblies to force the handrail against a drive surface of the first and second drive wheel assemblies.

12. The handrail drive apparatus of claim 11, wherein the plurality of pinch rollers are coupled to one another such that each pinch roller applies equal force to the handrail.

13. The handrail drive apparatus of claim 11, further comprising a cable coupling each of the plurality of pinch rollers to one another, the cable having a first end adjustably secured to a frame of the apparatus and a second end fixedly secured to the frame of the apparatus, and wherein each of the plurality of pinch rollers comprises at least one pulley arranged to receive the cable such that tension in the cable forces the pinch roller against the handrail in a direction substantially normal to a direction of movement of the handrail.

14. The handrail drive apparatus of claim 13, wherein the first end of the cable is attached to an adjustment mechanism, the adjustment mechanism including:

a threaded portion engaged by a nut; and a compression spring disposed between the nut and the frame of the apparatus to adjustably secure the cable to the frame.

15. The handrail drive apparatus of claim 11, further comprising a cable coupling each of the plurality of pinch rollers to one another, wherein the cable is adjustably secured to a frame of the handrail drive apparatus at a first point along its length and is fixedly secured to the frame of the apparatus at a second point along its length, and wherein each of the plurality of pinch rollers comprises at least one pulley arranged to receive the cable such that tension in the cable forces the pinch roller against the handrail in a direction substantially normal to a direction of movement of the handrail.

16. The handrail drive apparatus of claim 15, wherein the cable is adjustably secured to the frame by an adjustment mechanism, the adjustment mechanism including:

a pulley over which the cable passes;

a threaded portion engaged by a nut; and a compression spring disposed between the nut and the frame of the apparatus.

17. A handrail drive apparatus comprising:

a first driving wheel member arranged to drive a handrail;

a second driving wheel member coupled to the first driving wheel member and arranged to drive the handrail; and means for dividing a torque imparted to the first driving wheel substantially equally between the first and second driving wheel members.

18. A handrail drive apparatus comprising:

a first driving wheel member arranged to drive a handrail and comprising a power transmission mechanism; and a second driving wheel member coupled to the first driving wheel member and arranged to drive the handrail, wherein the power transmission mechanism is configured to divide a torque imparted to the first driving wheel member substantially equally between the first and second driving wheel members.

19. The handrail drive apparatus of claim 18, further comprising:

an additional driving wheel member arranged to drive the handrail and comprising an additional power transmission mechanism including an input and an output, wherein the input of the additional power transmission mechanism is arranged to receive an input torque and the output of the additional power transmission mechanism is coupled to the power transmission mechanism of the first driving wheel member to impart torque thereto, and wherein the additional power transmission mechanism is configured to divide the input torque between the additional and first driving wheel members such that the input torque is divided substantially equally between the additional, first, and second driving wheel members.

* * * * *